US008606123B2

(12) United States Patent
Arai et al.

(10) Patent No.: US 8,606,123 B2
(45) Date of Patent: Dec. 10, 2013

(54) IMAGE FORMING DEVICE WITH MOUNTED REPLACEABLE UNIT, METHOD OF CHECKING OPERATION IN THAT IMAGE FORMING DEVICE, AND STORAGE MEDIUM STORING OPERATION CHECKING PROGRAM DIRECTED TO THAT IMAGE FORMING DEVICE

(75) Inventors: Junichi Arai, Chiryu (JP); Hiroaki Takatsu, Nishio (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 170 days.

(21) Appl. No.: 13/007,346

(22) Filed: Jan. 14, 2011

(65) Prior Publication Data

US 2011/0182594 A1 Jul. 28, 2011

(30) Foreign Application Priority Data

Jan. 28, 2010 (JP) ..... 2010-016438

(51) Int. Cl.
*G03G 15/00* (2006.01)

(52) U.S. Cl.
USPC ..... 399/12

(58) Field of Classification Search
USPC ..... 399/12
See application file for complete search history.

(56) References Cited

U.S. PATENT DOCUMENTS 5,491,540 A * 2/1996 Hirst ..... 399/12
5,973,569 A * 10/1999 Nguyen ..... 330/298
6,104,888 A * 8/2000 Kobayashi ..... 399/12
7,263,300 B2 * 8/2007 Ishii et al. ..... 399/27
2005/0105922 A1 5/2005 Kawai
2006/0133835 A1 6/2006 Kimura et al.

FOREIGN PATENT DOCUMENTS

CN 1605953 4/2005
CN 1776544 5/2006
CN 101334625 12/2008
EP 1 255 170 11/2002
JP 5-40373 2/1993
JP 2003-241589 8/2003
JP 2003241589 A * 8/2003 ..... G03G 21/00
JP 2007-41392 2/2007

OTHER PUBLICATIONS

Japanese Notice of Grounds of Rejection mailed Nov. 8, 2011, directed to Japanese Patent Application No. 2010-016438; 7 pages.
Notification of the First Office Action dated Jan. 11, 2013, directed to CN Application No. 201110031422.1; 12 pages.

* cited by examiner

*Primary Examiner* — David Gray
*Assistant Examiner* — Carla Therrien
(74) *Attorney, Agent, or Firm* — Morrison & Foerster LLP

(57) ABSTRACT

When a unit containing a fuse is mounted, in response to detection of a potential indicating that the fuse has not been blown by a detection circuit, a current for blowing the fuse is supplied from a blowing circuit to the mounted unit containing the fuse, and operation of the blowing circuit is checked based on potentials detected by the detection circuit before current supply and after current supply, respectively. When a unit containing a non-blown component instead of a fuse is mounted, a current is supplied from the blowing circuit to the mounted unit containing the non-blown component, and operation of the blowing circuit is checked based on potentials detected by the detection circuit before current supply and during current supply, respectively, or potentials detected by the detection circuit before current supply and after current supply, respectively.

9 Claims, 9 Drawing Sheets

| CUTOFF REMOTE SETTING | DETECTION MONITOR LINE | |
|---|---|---|
| | FUSE-CONTAINING | ELECTRIC RESISTOR-CONTAINING |
| OFF | HI | HI |
| DURING ON | INDETERMINATE | LO |
| OFF AFTER ON | LO | HI |

IMAGE FORMING DEVICE WITH MOUNTED REPLACEABLE UNIT, METHOD OF CHECKING OPERATION IN THAT IMAGE FORMING DEVICE, AND STORAGE MEDIUM STORING OPERATION CHECKING PROGRAM DIRECTED TO THAT IMAGE FORMING DEVICE

This application is based on Japanese Patent Application No. 2010-016438 filed with the Japan Patent Office on Jan. 28, 2010, the entire content of which is hereby incorporated by reference.

BACKGROUND OF THE INVENTION

1. Field of the Invention

The present invention relates to an image forming device with a mounted replaceable unit which indicates a state thereof depending on whether or not a contained fuse has been blown, a method of checking operation in the image forming device, and a storage medium storing an operation checking program directed to the image forming device.

2. Description of the Related Art

Conventionally, image forming devices (copying machines, printers, facsimiles, and Multifunction Peripherals) generally have mounted units required for image forming operation. Examples of such replaceable units (hereinafter also referred to simply as "units") include a toner unit for supplying toner used for printing, an imaging unit having a photoconductor, a transfer body and the like.

An image forming device needs to obtain a state of a mounted unit (e.g., information that the unit is new or used) for proper operation. A known structure for obtaining a state of a unit includes a nonvolatile memory or the like contained in each unit, with necessary information stored in the nonvolatile memory.

Also known is a more simplified structure, in which a unit contains therein a component (typically a fuse) whose state value can be electrically changed, and a state of the unit is obtained based on an electrical state of this component.

As an example of the latter structure, Japanese Laid-Open Patent Publication No. 05-040373 discloses a technique of determining whether a unit is new or used based on whether or not a fuse contained in the unit has been blown. Japanese Laid-Open Patent Publication No. 2007-041392 discloses a structure in which a fuse is contained as a circuit for detecting that a replaceable unit is new, and the fuse is blown when it is detected that the unit is new.

When a structure in which a fuse contained in a unit is blown in response to mounting of the unit on an image forming device as described above is employed, operation of a circuit for performing blowing operation (hereinafter also referred to as a "fuse blowing circuit") can be checked as well during the blowing operation.

When shipped from a factory, such image forming device generally has units required for performing image forming processing already mounted thereon. Namely, the image forming device is shipped after completion of mounting of required units, fuse blowing operation in the units, checking of operation of the fuse blowing circuit, an initialization process on the mounted units, and the like. Stated another way, in an image forming device after being shipped from a factory, fuse blowing operation is not performed in principle for units already mounted at a shipment stage.

A fuse is a relatively expensive component. Accordingly, a fuse contained in a unit already mounted on an image forming device at a shipment stage from a factory (hereinafter also referred to as an "included unit") could be eliminated to reduce manufacturing costs. Yet even in this case, a new unit to be mounted after the included unit reaches the end of its life needs to contain a fuse.

Fuse blowing operation in a unit also serves to check operation of a fuse blowing circuit, and simply eliminating a fuse in a unit results in inability to check operation of the fuse blowing circuit. It may thus be necessary to additionally perform another method of checking operation (e.g., an operation checking step of inspection by installing a jig dedicated to checking operation of a fuse blowing circuit on an inspection line for an image forming device, and then removing the jig), which rather increases the manufacturing costs.

SUMMARY OF THE INVENTION

The present invention was made to solve the problems as stated above, and an object of the present invention is to provide an image forming device capable of checking operation of a fuse blowing circuit when any one of a replaceable unit which indicates a state thereof depending on whether or not a contained fuse has been blown, and a less expensive replaceable unit containing a non-blown component instead of the fuse is mounted thereon. The present invention can also provide a method of checking operation in the image forming device, and a storage medium storing an operation checking program directed to the image forming device.

An image forming device according to an aspect of the present invention includes an interface for mounting a replaceable unit, a blowing circuit for supplying a current for blowing a fuse when a unit containing the fuse is mounted, a detection circuit forming a circuit including the fuse contained in the mounted unit, for detecting a potential varying depending on whether or not the fuse has been blown, and a controller. When a unit containing a fuse is mounted, in response to detection of a potential indicating that the fuse has not been blown by the detection circuit, the controller causes the blowing circuit to supply a current for blowing the fuse to the mounted unit containing the fuse, and checks operation of the blowing circuit based on potentials detected by the detection circuit before current supply and after current supply, respectively. When a unit containing a non-blown component instead of a fuse is mounted, the controller causes the blowing circuit to supply a current to the mounted unit containing the non-blown component, and checks operation of the blowing circuit based on potentials detected by the detection circuit before current supply and during current supply, respectively, or potentials detected by the detection circuit before current supply and after current supply, respectively.

Preferably, the replaceable unit includes an identification component indicating which one of the fuse and the non-blown component is contained, and the image forming device further includes a type-specifying circuit for specifying a type of a mounted unit by electrical connection to the identification component.

Preferably, the controller determines that the blowing circuit is operating normally if a potential detected by the detection circuit while the blowing circuit supplies a current to the unit containing the non-blown component instead of a fuse is different from a potential detected by the detection circuit while the blowing circuit does not supply a current to the unit.

Still preferably, the controller determines that the blowing circuit is operating normally if a potential detected by the detection circuit after the blowing circuit supplies a current to the unit containing the non-blown component instead of a fuse over a certain period is not different from a potential detected by the detection circuit while the blowing circuit does not supply a current to the unit.

Preferably, the blowing circuit supplies a current to the unit containing the non-blown component instead of a fuse when operation of the blowing circuit for the unit has not been checked in the past.

Still preferably, the controller includes a storage unit for storing a history of checking operation of the blowing circuit.

Preferably, the non-blown component is a resistance element.

According to another aspect of the present invention, a method of checking operation of an image forming device with a mounted replaceable unit is provided. The image forming device includes an interface capable of mounting any one of a first type unit containing a fuse for indicating whether the unit is in a first state or a second state, and a second type unit containing a non-blown component instead of the fuse in the first type unit. The method includes the steps of specifying, after the replaceable unit is mounted on the image forming device, whether the mounted unit is of the first type or the second type, detecting, when it is specified that the first type unit has been mounted, a potential varying depending on whether or not the fuse has been blown by a detection circuit forming a circuit together with the fuse contained in the unit, determining whether the mounted first type unit is in the first state or the second state based on the detected potential, supplying a current for blowing the fuse contained in the unit from a blowing circuit when the mounted first type unit is in the first state, checking operation of the blowing circuit based on potentials detected before current supply and after current supply, respectively, at the detection circuit including the fuse contained in the mounted first type unit, determining whether or not operation of the blowing circuit has been checked in the past when it is specified that the second type unit has been mounted, supplying a current to the non-blown component contained in the mounted second type unit from the blowing circuit when operation of the blowing circuit has not been checked in the past, and checking operation of the blowing circuit based on potentials detected by the detection circuit before current supply and during current supply, respectively, or potentials detected by the detection circuit before current supply and after current supply, respectively. The detection circuit forms a circuit together with the non-blown component contained in the mounted second type unit.

According to still another aspect of the present invention, a storage medium storing an operation checking program to be executed by an image forming device with a mounted replaceable unit is provided. The image forming device includes an interface capable of mounting any one of a first type unit containing a fuse for indicating whether the unit is in a first state or a second state, and a second type unit containing a non-blown component instead of the fuse in the first type unit. The operation checking program includes instructions for specifying, after the replaceable unit is mounted on the image forming device, whether the mounted unit is of the first type or the second type, instructions for obtaining, when it is specified that the first type unit has been mounted, a potential varying depending on whether or not the fuse has been blown from a circuit including the fuse contained in the unit, instructions for determining whether the mounted first type unit is in the first state or the second state based on the obtained potential, instructions for causing a blowing circuit to supply a current for blowing the fuse contained in the unit when the mounted first type unit is in the first state, instructions for checking operation of the blowing circuit based on potentials before current supply and after current supply, respectively, obtained from the circuit including the fuse contained in the mounted first type unit, instructions for determining whether or not operation of the blowing circuit has been checked in the past when it is specified that the second type unit has been mounted, instructions for supplying a current to the non-blown component contained in the mounted second type unit from the blowing circuit when operation of the blowing circuit has not been checked in the past, and instructions for checking operation of the blowing circuit based on potentials detected before current supply and during current supply, respectively, or potentials detected before current supply and after current supply, respectively, at a circuit including the non-blown component contained in the mounted second type unit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
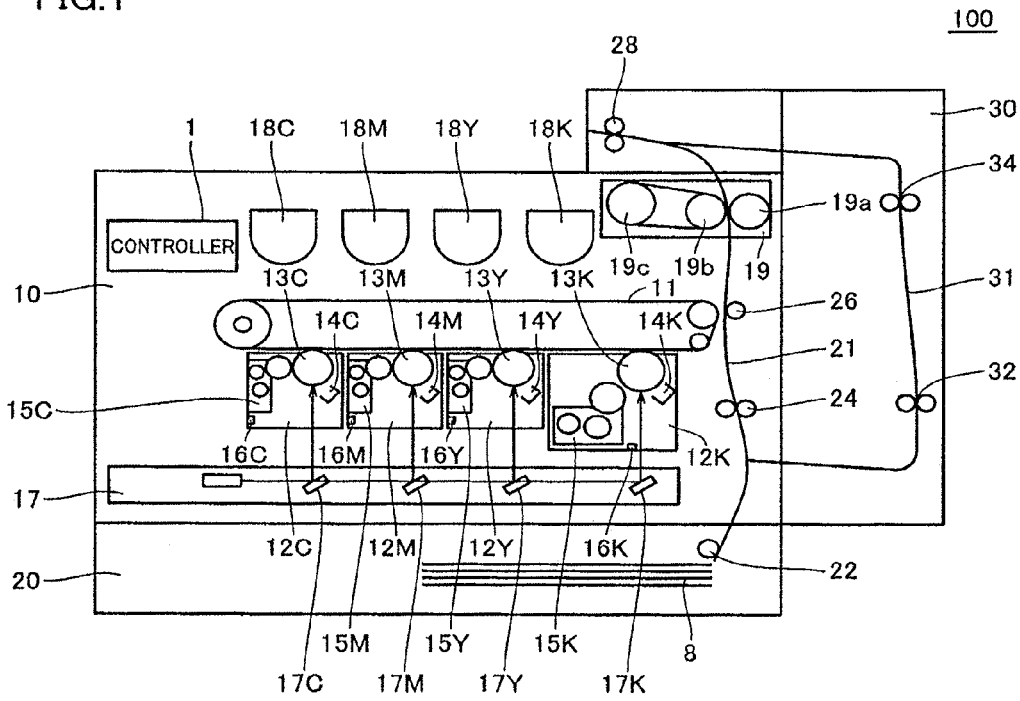
FIG. 1 is a schematic structure diagram of an image forming device according to an embodiment of the present invention.

An embodiment of the present invention will be described in detail with reference to the drawings. It is noted that the same or corresponding parts have the same reference signs allotted in the drawings, and description thereof will not be repeated.

<A. Overall Structure>

First, referring to FIG. 1, an overall structure of an image forming device 100 according to the present embodiment is described. FIG. 1 illustrates a typical example of the image forming device according to the present invention, with a tandem-type color print engine installed thereon. The present invention is applicable, however, to any type of image forming device on which a replaceable unit can be mounted. The image forming device according to the present invention may thus be implemented as a copying machine, a printer, a facsimile, and a Multifunction Peripheral. In addition, any type of print engine including color/monochrome, laser system/inkjet system/thermal system/dot impact system, and tandem system/cycle system engines may be employed.

Referring to FIG. 1, image forming device 100 includes a controller 1, a print engine 10, a stacker 20, and a double-side unit 30. Print engine 10 includes a transfer belt 11, developing units 12C, 12M, 12Y, 12K, a print head unit 17, toner units 18C, 18M, 18Y, 18K, and a fuser 19.

Controller 1 is responsible for overall processing of image forming device 100 in addition to a process of determining a state of a unit to be described later.

Developing units 12C, 12M, 12Y, and 12K form toner images of cyan (C), magenta (M), yellow (Y), and black (K), respectively. Developing units 12C, 12M, 12Y, and 12K are also collectively called a "developing unit 12." In FIG. 1, "C", "M", "Y", and "K" are added to the reference signs in order to distinguish among their colors.

Developing units 12C, 12M, 12Y, and 12K are aligned along a direction in which transfer belt 11 moves, and the color toner images corresponding to and formed by the respective units in developing unit 12 are successively superimposed on one another on transfer belt 11.

Each unit in developing unit 12 includes a photoconductor 13, a charger 14 for charging photoconductor 13, and a developing device 15 for applying toner to an electrostatic latent image formed on charged photoconductor 13 to form a toner image of a corresponding color on photoconductor 13. The electrostatic latent image on photoconductor 13 is formed when print head unit 17 exposes photoconductor 13 to light in response to an image formation request.

Toner units 18C, 18M, 18Y, and 18K supply toner of their corresponding colors to developing devices 15C, 15M, 15Y, and 15K, respectively.

A secondary transfer roller 26 transfers the toner images that have been superimposed on one another on transfer belt 11 to a sheet 8. Then, fuser 19 fixes the toner image that has been transferred to sheet 8 with heat and pressure. Specifically, fuser 19 includes a pressure roller 19*a*, and heating rollers 19*b* and 19*c*. Heating roller 19*c* includes a heater therein, and a medium rotating between heating rollers 19*b* and 19*c* is controlled to a prescribed temperature. When sheet 8 to which the toner image has been transferred passes through fuser 19, pressure is applied from pressure roller 19*a* and heat is applied from heating roller 19*b* to fix the toner image on sheet 8.

Stacker 20 holds sheet 8. In response to an image formation request, a takeout roller 22 takes sheet 8 out of stacker 20, and transfers it along a transfer path 21. Transfer path 21 is provided with secondary transfer roller 26 as well as a timing roller 24. Timing roller 24 supplies transferred sheet 8 to secondary transfer roller 26 at timing synchronous with a position of the toner image that has been formed on transfer belt 11.

Transfer path 21 is further provided with an ejection roller 28. Ejection roller 28 transfers the printed material on which the toner image has been fixed by fuser 19 to an ejection tray. When sheet 8 is subjected to double-sided printing, ejection roller 28 returns sheet 8 that has been subjected to one-sided printing to a double-side unit 30. That is, upon arrival of sheet 8 having the toner image fixed on one side thereof by fuser 19, ejection roller 28 rotates in a direction opposite to a normal direction, to transfer sheet 8 to double-side unit 30.

In double-side unit 30, transfer rollers 32 and 34 are arranged along a return path 31. Transfer rollers 32 and 34 return sheet 8 to stacker 20 along return path 31. Then, a toner image is fixed on the other side of sheet 8 by the same process.

<B. Replaceable Unit>

A "replaceable unit" according to the present embodiment may refer to toner units 18C, 18M, 18Y, 18K, developing units 12C, 12M, 12Y, 12K, fuser 19, transfer belt 11 and the like shown in FIG. 1. That is, a "replaceable unit" according to the present embodiment may mean basically a consumable having a relatively short life as compared to useful life of image forming device 100, which is originally intended to be replaced.

In principle, such replaceable unit contains a fuse for at least determining whether or not the unit is new. Such unit containing a fuse is also referred to as "fuse-containing" or a "fuse-containing unit" in order to be distinguished from a unit to be described later.

It is noted that a "fuse" used in the present specification may refer to a component that may be disconnected as a result of prescribed electrical operation.

The image forming device according to the present embodiment is also applicable to an inexpensive unit containing a resistor instead of the fuse in the fuse-containing unit described above. Such unit containing a resistor is also referred to as "resistor-containing" or a "resistor-containing unit."

Each replaceable unit according to the present embodiment contains a state detection chip including such fuse or resistor, so that image forming device 100 can obtain a state of the unit (typically, whether or not the unit is new). In the example illustrated in FIG. 1, developing units 12C, 12M, 12Y, and 12K contain state detection chips 16C, 16M, 16Y, and 16K, respectively.

A circuit configuration for detecting a state of a replaceable unit by using the above state detection chip will be described below.

<C. Configuration Related to Detection of State of Unit>

Figure 2:
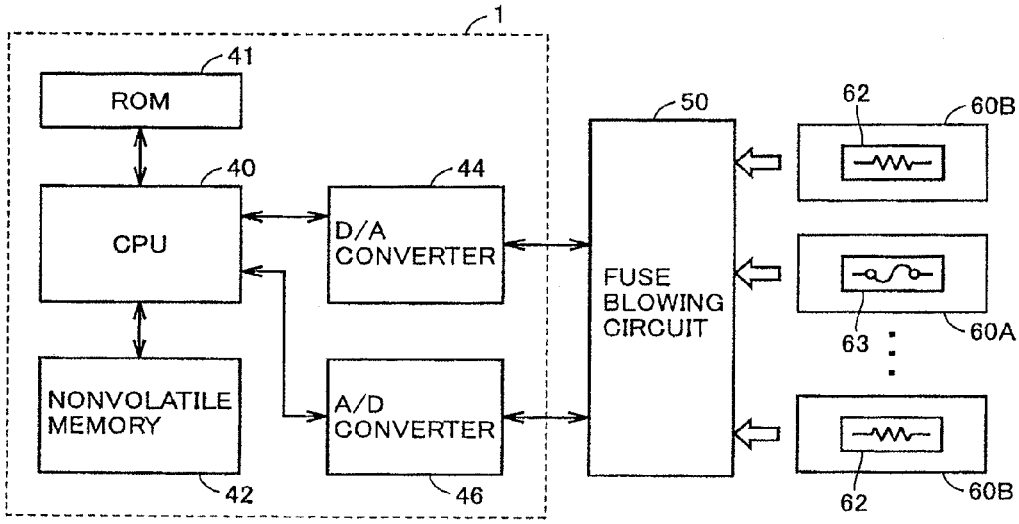
FIG. 2 is a block diagram related to detection of a state of a unit in the image forming device according to the embodiment of the present invention.

Referring to FIG. 2, a fuse-containing unit 60A or a resistor-containing unit 60B is mounted on the image forming device. That is, fuse-containing unit 60A includes a fuse 63 for indicating whether or not the unit is new, and resistor-containing unit 60B includes a resistance element (hereinafter referred to simply as a "resistor") which is a non-blown component instead of fuse 63. While one fuse-containing unit 60A and two resistor-containing units 60B are mounted in the example illustrated in FIG. 2, this combination may change depending on usage of image forming device 100.

A fuse blowing circuit 50 is electrically connected to these units mounted on the image forming device. Fuse blowing circuit 50 is also electrically connected to controller 1. As will be described later, fuse blowing circuit 50 includes a blowing circuit for supplying a current for blowing a fuse when a unit containing the fuse is mounted, and a detection circuit forming a circuit including the fuse contained in the mounted unit, for detecting a potential varying depending on whether or not the fuse has been blown.

Controller 1 includes a CPU (Central Processing Unit) 40, a ROM (Read Only Memory) 41, a nonvolatile memory 42, a D/A (Digital to Analog) converter 44, and an A/D (Analog to Digital) converter 46.

CPU 40 provides various functions related to operation of image forming device 100 by performing processing in accordance with a prepared program. The program executed by CPU 40 is typically stored in ROM 41.

Nonvolatile memory 42 is typically formed of a flash memory or the like, and holds information required for operation of image forming device 100. For example, nonvolatile memory 42 holds a count value related to image forming operation, as well as a history of checking operation of fuse blowing circuit 50 and a state of a mounted unit (whether or not the unit has been initialized, a result of concentration adjustment, and the like), as will be described later. That is, nonvolatile memory 42 functions as a storage unit for storing the operation checking history of fuse blowing circuit 50.

D/A converter 44 outputs an analog value (potential) in response to a digital instruction provided from CPU 40. Typically, D/A converter 44 provides a potential of high ("HI") level or low ("LO") level to a transistor and the like included in fuse blowing circuit 50 to be described later.

A/D converter 46 compares an input analog value (potential) with a reference potential, and outputs a digital value (a binary of HI level or LO level, or a 256-level quantized value) and the like to CPU 40.

Fuse blowing circuit 50 includes an interface circuit for electrically connecting to fuse-containing unit 60A or resistor-containing unit 60B mounted on the image forming device, a circuit for blowing fuse 63 included in fuse-containing unit 60A, and a circuit for determining whether or not a fuse in a mounted unit has been blown.

Figure 3:
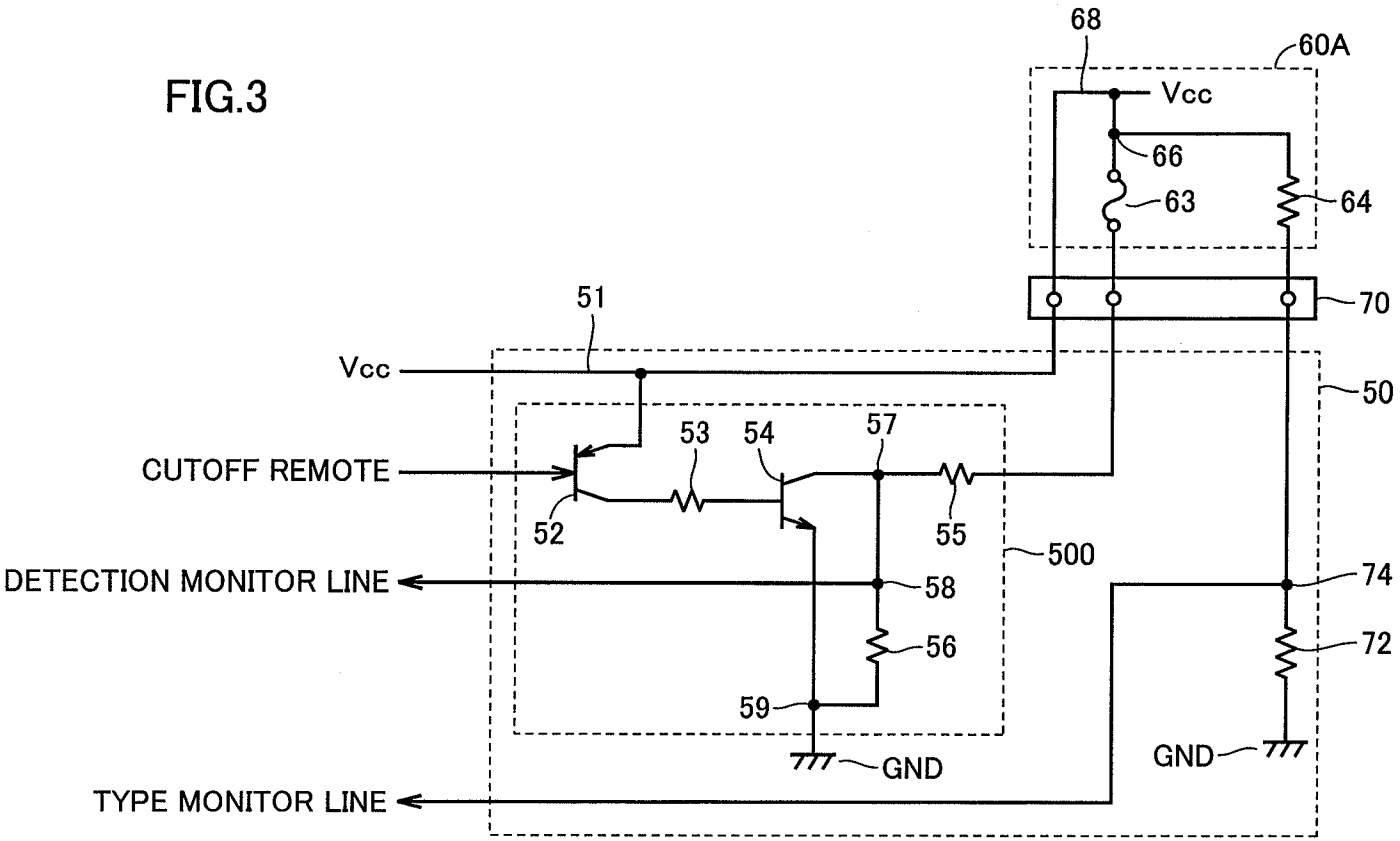
FIG. 3 shows an example of a circuit configuration (when a fuse-containing unit is mounted) related to state detection in the image forming device according to the embodiment of the present invention.
Figure 4:
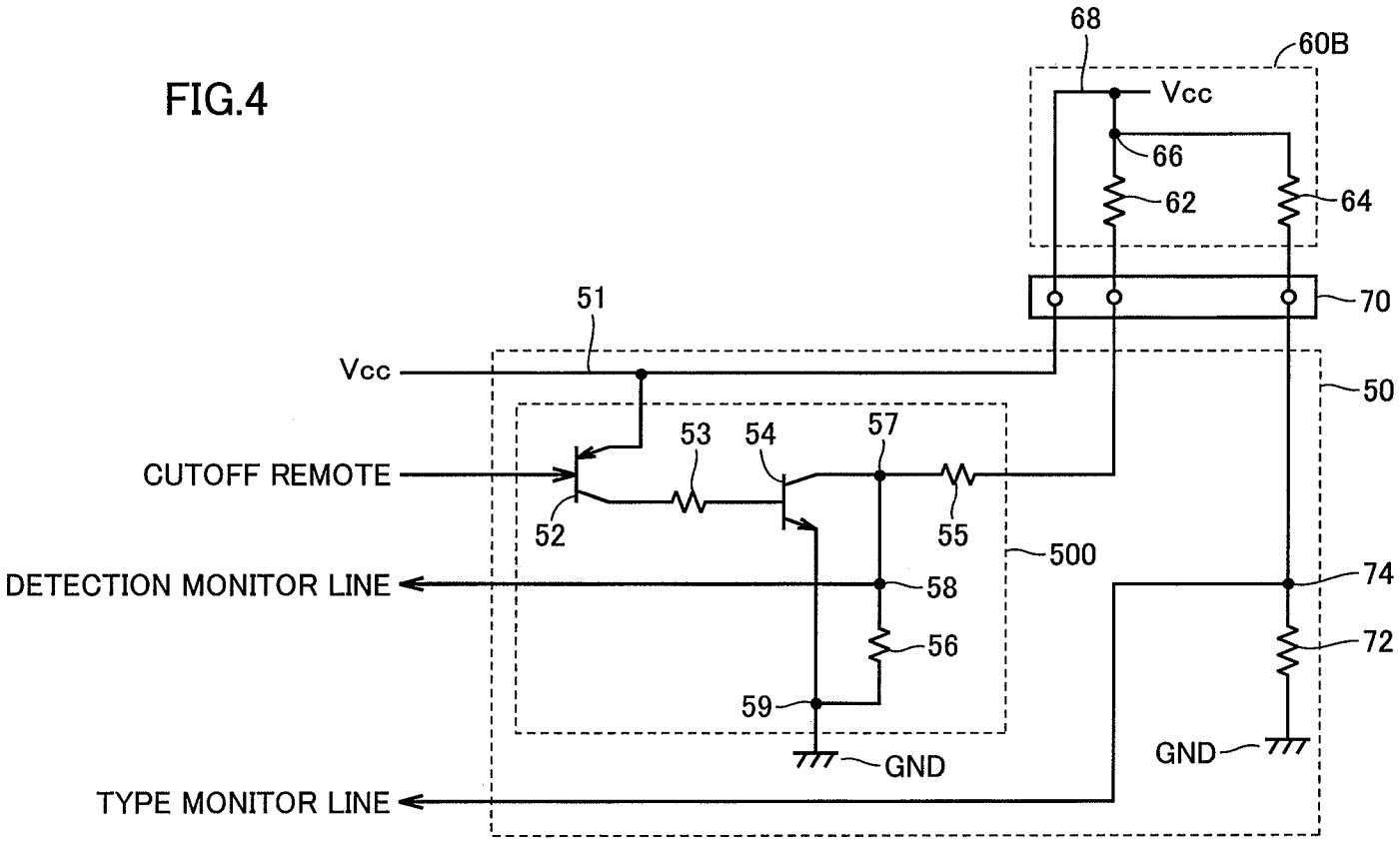
FIG. 4 shows an example of a circuit configuration (when a resistor-containing unit is mounted) related to state detection in the image forming device according to the embodiment of the present invention.

FIG. 3 shows an example of an electric circuit configured between one unit and fuse blowing circuit 50, when fuse-containing unit 60A is mounted on the image forming device. FIG. 4 shows an example of an electric circuit configured between one unit and fuse blowing circuit 50, when resistor-containing unit 60B is mounted on the image forming device.

Referring to FIG. 3, fuse blowing circuit 50 is electrically connected to fuse-containing unit 60A via a connector 70. Image forming device 100 includes, in addition to connector 70 shown in FIG. 3, a portion mechanically coupled to a replaceable unit as an interface for mounting the unit.

Fuse blowing circuit 50 includes a power supply line 51 connected to a power supply unit (not shown) of the image forming device. A control power supply Vcc (typically 5V) is supplied to power supply line 51. Power supply line 51 is electrically connected to a power supply line 68 of fuse-containing unit 60A. In addition, fuse-containing unit 60A includes fuse 63 having one end electrically connected to power supply line 68, and a chip-type-indicating resistor 64 having one end electrically connected to a node 66.

Chip-type-indicating resistor 64 has a resistance value that allows identification of a type of its corresponding unit. In the present embodiment, chip-type-indicating resistor 64 is selected to have different resistance values in order to at least distinguish between fuse-containing unit 60A and resistor-containing unit 60B. That is, chip-type-indicating resistor 64 is an example of an identification component for indicating which one of fuse 63 and a resistor 62 is contained. A type of a mounted unit is specified by electrical connection to chip-type-indicating resistor 64 which is an identification component. Other examples of an identification component that can be used include an IC tag and a bar code.

Each of fuse 63 and chip-type-indicating resistor 64 has the other end connected to an independent port in connector 70.

Fuse blowing circuit 50 includes a resistor 55 and a transistor 54 connected to fuse 63 via connector 70. Transistor 54 has an emitter electrically connected to a ground GND. That is, fuse 63, resistor 55, and transistor 54 are connected in series between power supply line 68 and ground GND.

In addition, a resistor 56 is electrically connected between a node 57 intermediate between resistor 55 and a collector of transistor 54, and a node 59 intermediate between the emitter of transistor 54 and ground GND. A potential appearing on a node 58 intermediate between resistor 56 and node 57 is input to A/D converter 46 shown in FIG. 2 as a detection monitor line.

Fuse blowing circuit 50 further includes a transistor 52 having an emitter electrically connected to power supply line 51. Transistor 52 has a collector connected to a base of transistor 54 via a resistor 53. A cutoff remote signal is supplied to a base of transistor 52 from D/A converter 44 shown in FIG. 2.

That is, once fuse-containing unit 60A is mounted, a detection circuit including fuse 63 contained in fuse-containing unit 60A is formed, and a potential varying depending on whether or not fuse 63 has been blown is detected as the detection monitor line.

Fuse blowing circuit 50 further includes a resistor 72 having one end electrically connected to chip-type-indicating resistor 64 via connector 70. Resistor 72 has the other end electrically connected to ground GND. That is, chip-type-indicating resistor 64 and resistor 72 are connected in series between power supply line 68 and ground GND. A potential appearing on a node 74 intermediate between chip-type-indicating resistor 64 and resistor 72 is input to A/D converter 46 shown in FIG. 2 as a type monitor line.

On the other hand, as shown in FIG. 4, resistor-containing unit 60B contains resistor 62 instead of fuse 63. Resistor-containing unit 60B is otherwise the same in configuration as fuse-containing unit 60A except that chip-type-indicating resistor 64 has a different resistance value from that of chip-type-indicating resistor 64 included in fuse-containing unit 60A, and thus the description thereof is not repeated.

As shown in FIGS. 3 and 4, a potential in accordance with a ratio between a resistance value of chip-type-indicating resistor 64 and a resistance value of resistor 72 appears in the type monitor line. Accordingly, if the resistance value of resistor 72 is already known, the resistance value of chip-type-indicating resistor 64, namely, a type of a mounted unit can be specified based on this potential in the type monitor line.

<D. Fuse Blowing Operation>

Next, operation of blowing fuse 63 shown in FIG. 3 is described. A circuit indicated with a reference sign 500 shown in FIGS. 3 and 4 blows fuse 63 in fuse-containing unit 60A.

Timing of blowing fuse 63 is in principle immediately after each fuse-containing unit 60A is newly mounted on the image forming device. As will be described later, if CPU 40 (FIG. 2) determines that fuse 63 in mounted fuse-containing unit 60A needs to be blown, CPU 40 switches the cutoff remote signal to "ON". When the cutoff remote signal is switched to "ON" in the circuits shown in FIGS. 3 and 4, a potential of low level (LO) is supplied to the base of transistor 52. That is, a potential of high level (HI) continues to be supplied to the base of transistor 52 while the cutoff remote signal is "OFF."

Switching of the cutoff remote signal to "ON" causes transistor 52 to be activated to enter a conducting state. Here, a potential (high level) of control power supply Vcc is supplied to the base of transistor 54 via resistor 53. Thus, transistor 54 is also activated to enter a conducting state. As a result, a current (blowing current) flows from power supply line 68 of fuse-containing unit 60A successively through fuse 63, connector 70, resistor 55, transistor 54, and ground GND. Fuse 63 is blown after this blowing current continues to flow over a certain period.

CPU 40 (FIG. 2) returns the cutoff remote signal to "OFF" after a lapse of a predetermined period since the cutoff remote signal was switched to "ON". That is, the potential supplied to the base of transistor 52 is changed from low level (LO) to high level (HI). Thus, transistor 52 is inactivated again to return to a non-conducting state, and transistor 54 also returns to a non-conducting state.

The operation of blowing fuse 63 contained in fuse-containing unit 60A is completed by a series of operations as described above.

Fuse blowing circuit 50 according to the present embodiment performs the same fuse blowing operation for resistor-containing unit 60B at the same timing as that for fuse-containing unit 60A. This is to check operation of fuse blowing circuit 50, as will be described later. However, resistor 62 contained instead of fuse 63 in resistor-containing unit 60B is sufficiently resistant to the blowing current that flows during this fuse blowing operation, so as not to be blown by the current.

For this reason, operation checking logic of fuse blowing circuit 50 when image forming device 100 has fuse-containing unit 60A mounted thereon cannot be applied as it is when image forming device 100 has resistor-containing unit 60B mounted thereon. In image forming device 100 according to the present embodiment, therefore, determination is made about which unit has been mounted, and then operation of fuse blowing circuit 50 is checked by using operation checking logic in accordance with the determined unit, as will be described later.

<E. Checking of Operation of Fuse Blowing Circuit>

Referring to FIGS. 5A to 5D and FIG. 6, checking of operation of fuse blowing circuit 50 which is performed during the above fuse blowing operation is described.

(1. Fuse-Containing Unit)

Figure 5A:
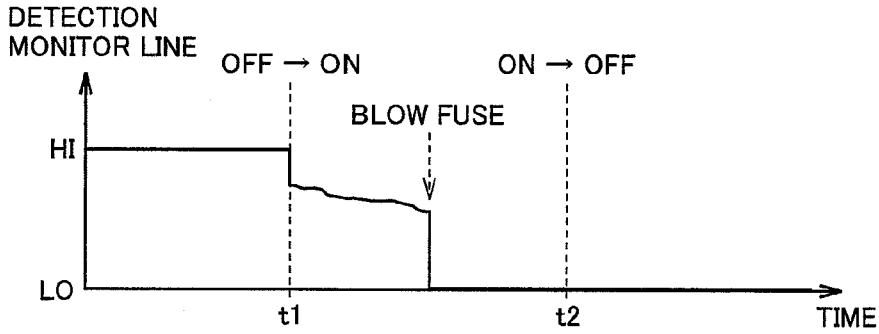
FIGS. 5A to 5D show temporal variations in potential appearing in a detection monitor line during fuse blowing operation according to the embodiment of the present invention.
Figure 5B:
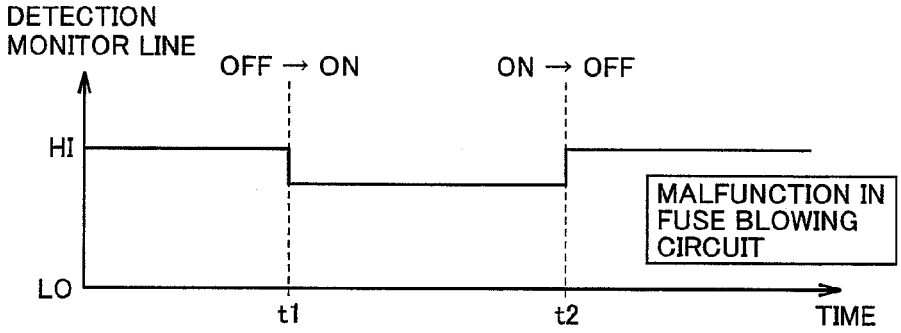

Referring to FIGS. 5A and 5B, operation checking logic of fuse blowing circuit 50 during the above fuse blowing operation for fuse-containing unit 60A is described. FIG. 5A shows an example of a case where fuse blowing circuit 50 is operating normally, and FIG. 5B shows an example of a case where fuse blowing circuit 50 does not work well.

First, assume that a fuse that has not been blown is contained. During a period when the fuse has not been blown and the cutoff remote signal is "OFF" in the circuit shown in FIG. 3, a current path is formed from power supply line 68 successively through node 66, fuse 63, connector 70, resistor 55, node 57, resistor 56, node 59, and ground GND. Since resistor 56 is set to have a relatively large resistance value, an actual current flowing continually is limited to a small value. Accordingly, fuse 63 is not blown. In addition, a potential corresponding to voltage drop caused by a current flowing through resistor 56 appears on node 58. As a result, a signal indicating a potential of high level (HI) appears in the detection monitor line during a period until time t1 in FIG. 5A.

Then, assume that the cutoff remote signal (FIG. 3) is switched from "OFF" to "ON" at time t1. Consequently, transistor 54 enters a conducting state in the circuit shown in FIG. 3, so that a current path is formed from node 57 through ground GND via transistor 54. This path serves as a bypass path of a current path from node 57 through ground GND via resistor 56. As a result, an increased through current flows from power supply line 68 toward ground GND. When this through current flows through fuse 63, fuse 63 is heated due to its resistance loss and ultimately blown. Since a resistance value of fuse 63 varies during the process of blowing fuse 63, the flowing through current varies with time in magnitude. After fuse 63 is ultimately blown, the through current does not flow because the current path is cut off.

While transistor 54 is in a conducting state, node 58 connected to the detection monitor line has substantially the same potential as node 57. That is, a potential corresponding to voltage drop that occurs across the collector and the emitter of transistor 54 appears in the detection monitor line. As a result, during a period between time t1 and time t2 in FIG. 5A, a potential intermediate between high level (HI) and low level (LO) appears in the detection monitor line until after fuse 63 is blown, and a potential of low level (LO) appears after fuse 63 is blown.

Then, assume that the cutoff remote signal (FIG. 3) is returned from "ON" to "OFF" at time t2. Time t2 is predetermined as an end of a period sufficient to blow fuse 63. Since the current path from power supply 68 through ground GND is not formed after fuse 63 is blown, as described above, the potential appearing in the detection monitor line is maintained at low level (LO).

The fuse blowing operation is completed by the procedure as stated above.

Operation of fuse blowing circuit 50 is checked by determining whether or not the potential appearing in the detection monitor line exhibits temporal variation such as shown in FIG. 5A. Therefore, if the potential appearing in the detection monitor line exhibits temporal variation different from the original variation, it can be determined that fuse blowing circuit 50 does not work well.

By way of example, FIG. 5B shows an example of a case where a resistance value of the current path does not decrease to a design value while transistor 54 shown in FIG. 3 is in a conducting state. In this case, a sufficiently large through current does not flow, resulting in inability to blow fuse 63. As a result, a potential of low level (LO) does not appear in the detection monitor line during the period between time t1 and time t2, as shown in FIG. 5B. Then, after the cutoff remote signal (FIG. 3) is returned from "ON" to "OFF" (after time t2), a potential of high level (HI) appears in the detection monitor line as in the period before time t1.

Accordingly, whether or not fuse blowing circuit 50 is operating normally can be determined based on the temporal variation of the potential appearing in the detection monitor line between time t1 and time t2, and/or the level of the potential appearing in the detection monitor line after time t2.

The temporal variation of the potential appearing in the detection monitor line when fuse blowing circuit 50 does not work well is not limited to that shown in FIG. 5B, and a plurality types of temporal variations may occur depending on a cause of failure.

(2. Resistor-Containing Unit)

Figure 5C:
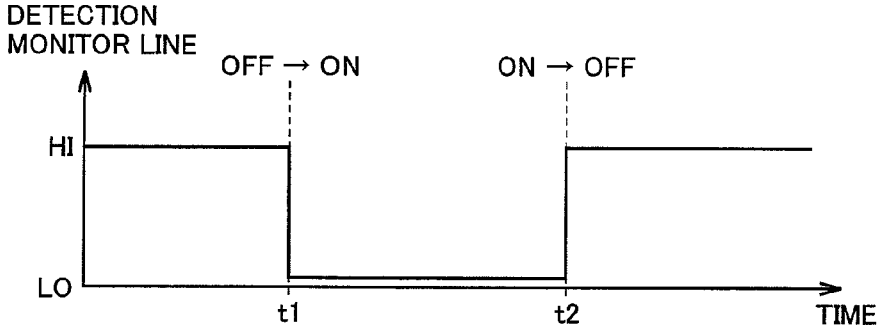
Figure 5D:
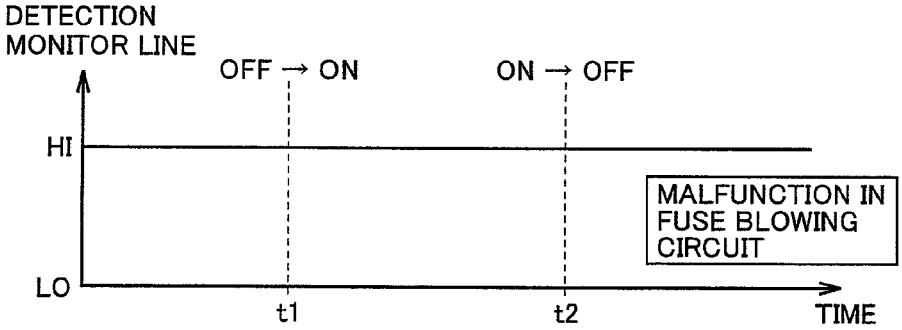

Referring to FIGS. 5C and 5D, operation checking logic of fuse blowing circuit 50 during the above fuse blowing operation for resistor-containing unit 60B is described. FIG. 5C shows an example of a case where fuse blowing circuit 50 is operating normally, and FIG. 5D shows an example of a case where fuse blowing circuit 50 does not work well.

When resistor-containing unit 60B is mounted on image forming device 100 according to the present embodiment, the same fuse blowing operation as that when fuse-containing unit 60A is mounted is performed. That is, in the circuit shown in FIG. 4, after the cutoff remote signal is switched from "OFF" to "ON", the signal is maintained at "ON" for a predetermined period (period between time t1 and time t2). Thereafter, the cutoff remote signal is returned from "ON" to "OFF" (time t2).

Resistor 62 in resistor-containing unit 60B is not blown even after the above fuse blowing operation is performed. Accordingly, if fuse blowing circuit 50 is operating normally, a potential appearing in the detection monitor line after the cutoff remote signal is returned from "ON" to "OFF" is identical to a potential that appeared in the detection monitor line in an initial state (when the cutoff remote signal was "OFF").

More specifically, during a period when the cutoff remote signal is "OFF" in the circuit shown in FIG. 4, a current path is formed from power supply line 68 successively through node 66, resistor 62, connector 70, resistor 55, node 57, resistor 56, node 59, and ground GND. Here, a potential corresponding to voltage drop caused by a current flowing through resistor 56 appears on node 58. As a result, a potential of high level (HI) appears in the detection monitor line during a period until time t1 in FIG. 5C.

On the other hand, during a period when the cutoff remote signal is "ON" in the circuit shown in FIG. 4, transistor 54 enters a conducting state, so that a current path is formed from node 57 through ground GND via transistor 54. This path serves as a bypass path of a current path from node 57 through ground GND via resistor 56. At this time, node 58 connected to the detection monitor line has substantially the same potential as node 57. That is, a potential corresponding to voltage drop that occurs across the collector and the emitter of transistor 54 appears in the detection monitor line.

However, since resistor 62 included in resistor-containing unit 60B is set to have a relatively large resistance value, a flowing through current is limited to a smaller value, unlike the case where fuse-containing unit 60A has been mounted. As a result, a potential of substantially low level (LO) appears in the detection monitor line during a period between time t1 and time t2 in FIG. 5C.

Then, assume that the cutoff remote signal (FIG. 4) is returned from "ON" to "OFF" at time t2. Here, the electrical characteristics of resistor 62 in resistor-containing unit 60B are not changed. Accordingly, the current path is formed again from power supply line 68 successively through node 66, resistor 62, connector 70, resistor 55, node 57, resistor 56, node 59, and ground GND. As a result, a potential of high level (HI) appears in the detection monitor line during a period after time t2 in FIG. 5C.

When resistor-containing unit 60B is mounted, therefore, temporal variation such as shown in FIG. 5C is employed as a potential originally appearing in the detection monitor line. Then, operation of fuse blowing circuit 50 is checked based on whether or not a potential appearing in the detection monitor line exhibits the temporal variation such as shown in FIG. 5C.

By way of example, FIG. 5D shows an example of a case where transistor 54 shown in FIG. 4 is not activated. In this case, the bypass path of the current path including transistor 54 is not formed even after the cutoff remote signal (FIG. 4) is changed from "OFF" to "ON". Thus, a potential appearing in the detection monitor line remains high level (HI) during a period between time t1 and time t2. That is, the potential appearing in the detection monitor line does not vary even after the cutoff remote signal (FIG. 4) is changed from "OFF" to "ON".

Accordingly, whether or not fuse blowing circuit 50 is operating normally can be determined based on the temporal variation of the potential appearing in the detection monitor line between time t1 and time t2, and/or the level of the potential appearing in the detection monitor line after time t2.

The temporal variation of the potential appearing in the detection monitor line when fuse blowing circuit 50 does not work well is not limited to that shown in FIG. 5D, and a plurality types of temporal variations may occur depending on a cause of failure.

(3. Conclusion)

As described above, image forming device 100 according to the present embodiment determines a type of a mounted unit (whether the unit is fuse-containing unit 60A or resistor-containing unit 60B) based on a resistance value of chip-type-indicating resistor 64 included in each unit, and checks operation of fuse blowing circuit 50 in accordance with the obtained type by using one of the temporal variations shown in FIGS. 5A and 5C as original variation.

Figures 6, 7:
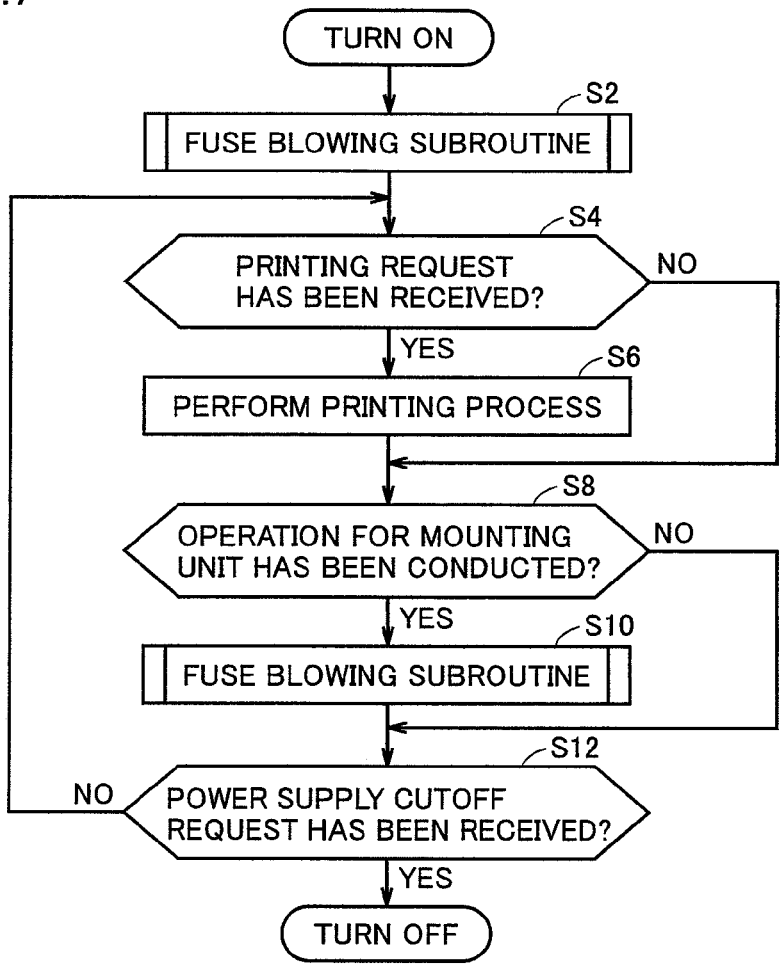
FIG. 6 shows a list of states of the potential appearing in the detection monitor line at each stage during the fuse blowing operation according to the embodiment of the present invention.
FIG. 7 is a flowchart showing an overall process related to a fuse blowing circuit 50 in an image forming device 100 according to the embodiment of the present invention.

FIG. 6 shows combination of potentials that should appear in the detection monitor line for each type of a unit mounted on image forming device 100. When the fuse blowing operation is performed for each mounted unit, operation of fuse blowing circuit 50 is checked based on whether or not a potential appearing in the detection monitor line exhibits the variation such as shown in FIG. 6.

<F. Procedure>

Referring to FIGS. 7 to 10, a procedure of fuse blowing circuit 50 in image forming device 100 according to an embodiment of the present invention is described. Steps shown in FIGS. 7 to 10 are typically provided when CPU 40 in controller 1 executes a program. Alternatively, the program may entirely or partially be installed as a dedicated hardware circuit.

(1. Overall Process)

A process shown in FIG. 7 is repeatedly performed while image forming device 100 is turned on. That is, when image forming device 100 is turned on, CPU 40 first executes a fuse blowing subroutine (step S2). This fuse blowing subroutine includes, for each mounted unit, (1) checking whether or not a fuse has been blown, (2) blowing the fuse (as necessary), (3) checking operation of fuse blowing circuit 50, (4) an initialization process on the unit, and the like. The fuse blowing subroutine will be described later in detail with reference to FIGS. 8 to 10.

At next step S4, CPU 40 determines whether or not a printing request has been received. If a printing request has been received (YES at step S4), CPU 40 performs a printing process (step S6). The process then proceeds to step S8. If a printing request has not been received (NO at step S4), the printing process is skipped, and the process proceeds to step S8.

At step S8, CPU 40 determines whether or not operation for mounting a unit has been conducted. Typically, CPU 40 determines whether or not operation of opening/closing a cover of image forming device 100, release of a lock of the unit and the like have been sensed.

If operation for mounting a unit has been conducted (YES at step S8), CPU 40 executes a fuse blowing subroutine (step S10). The process then proceeds to step S12. If operation for mounting a unit has not been conducted (NO at step S8), the fuse blowing subroutine is skipped, and the process proceeds to step S12.

At step S12, CPU 40 determines whether or not a power supply cutoff request has been received. If a power supply cutoff request has not been received (NO at step S12), CPU 40 repeats the process of step S4 and its subsequent steps. If a power supply cutoff request has been received (YES at step S12), the process ends.

(2. Fuse Blowing Subroutine)

Figure 8:
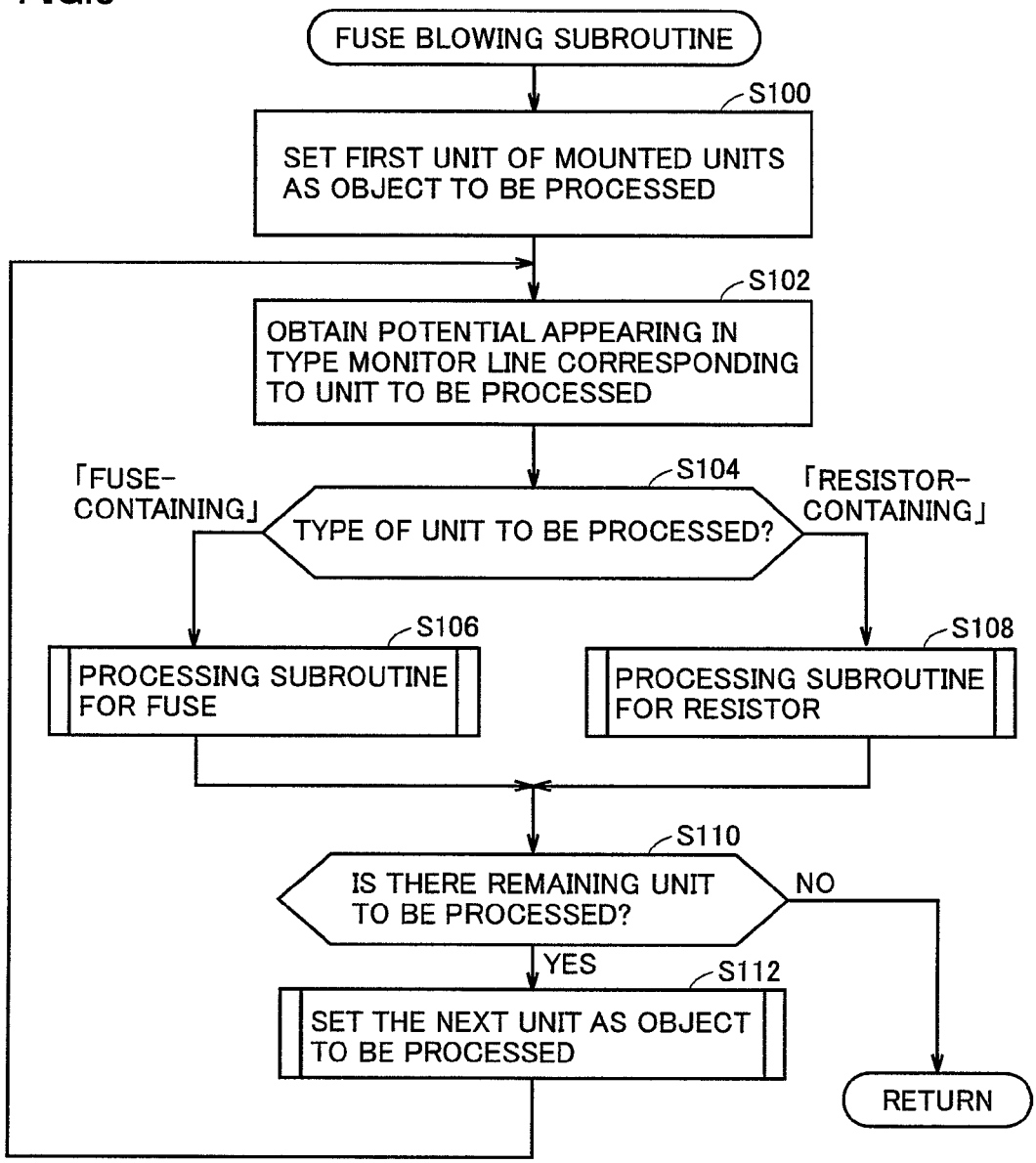
FIG. 8 is a flowchart showing contents of a fuse blowing subroutine performed at steps S2 and S10 shown in FIG. 7.

Next, referring to FIG. 8, the contents of the fuse blowing subroutine executed in steps S2 and S10 shown in FIG. 7 are described.

First, at step S100, CPU 40 sets a first unit of mounted units as an object to be processed.

At next step S102, CPU 40 obtains a potential appearing in the type monitor line which corresponds to the unit to be processed. That is, CPU 40 obtains a voltage value in accordance with a resistance value of chip-type-indicating resistor 64 contained in the unit to be processed. Then, at step S104, CPU 40 determines whether the unit to be processed is a fuse-containing unit or a resistor-containing unit. That is, after a unit is mounted on image forming device 100, CPU 40 specifies whether the mounted unit contains a fuse or a resistor.

If the unit to be processed is a fuse-containing unit ("FUSE-CONTAINING" at step S104), the process proceeds to step S106. If the unit to be processed is a resistor-containing unit ("RESISTOR-CONTAINING" at step S104), the process proceeds to step S108.

Figure 9:
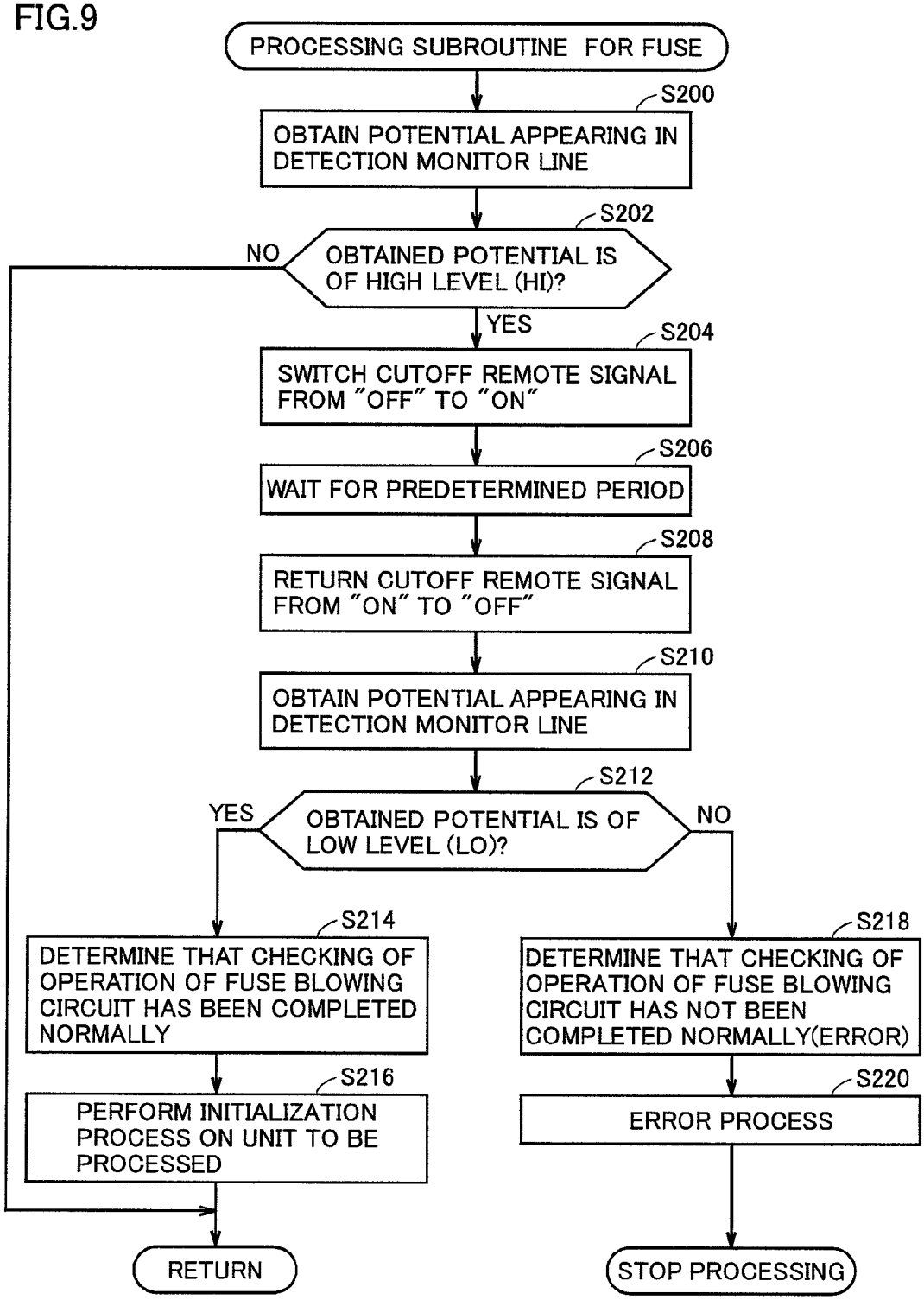
FIG. 9 is a flowchart showing contents of a processing subroutine for fuse performed at step S106 shown in FIG. 8.

At step S106, CPU 40 executes a processing subroutine for fuse shown in FIG. 9. After execution of the subroutine, the process proceeds to step S110. At step S108, CPU 40 executes a processing subroutine for resistor shown in FIG. 10. After execution of the subroutine, the process proceeds to step S110.

At step S110, CPU 40 determines whether or not there is a remaining unit to be processed. If there is a remaining unit to be processed (YES at step S110), the next unit is set as an object to be processed (step S112), and the process of step S102 and its subsequent steps is repeated.

If there is no remaining unit to be processed (NO at step S110), the process returns to the main routine shown in FIG. 7.

(3. Processing Subroutine For Fuse)

Next, referring to FIG. 9, the contents of the processing subroutine for fuse executed at step S106 shown in FIG. 8 are described.

First, at step S200, CPU 40 obtains a potential appearing in the detection monitor line which corresponds to a unit to be processed. At next step S202, CPU 40 determines whether or not the potential obtained at step S200 is of high level (HI). That is, CPU 40 determines whether or not a fuse contained in the unit to be processed has been blown, namely, whether or not the fuse is new.

In the process of step S202, when a unit containing fuse 63 (fuse-containing unit 60A) is mounted on image forming device 100, CPU 40 determines that the mounted unit is in a first state (new) if a potential indicating that fuse 63 has not been blown is detected, and determines that the mounted unit is in a second state (used) if a potential indicating that fuse 63 has been blown is detected. Stated another way, CPU 40 determines whether mounted fuse-containing unit 60A is in a first state or a second state based on a detected potential.

The above combination of potentials generated depending on whether or not fuse 63 has been blown is not restrictive, and the high level and the low level may be exchanged depending on a point where a potential is detected in the circuit.

If the potential obtained at step S200 is not of high level (HI) (NO at step S202), the process returns to the fuse blowing subroutine shown in FIG. 8. If the potential obtained at step S200 is of high level (HI) (YES at step S202), the process proceeds to step S204. Then, CPU 40 performs the fuse blowing process and checks operation of the fuse blowing circuit at step S204 and its subsequent steps.

At step S204, CPU 40 switches the cutoff remote signal from "OFF" to "ON", and waits for a predetermined period (step S206). That is, the cutoff remote signal is maintained at "ON" during a period required for blowing a fuse contained in a unit to be processed (period between t1 and t2 in FIG. 5A). Then, CPU 40 returns the cutoff remote signal from "ON" to "OFF" (step S208).

That is, if mounted fuse-containing unit 60A is in the first state (new), CPU 40 causes fuse blowing circuit 50 to supply a current for blowing fuse 63 contained in fuse-containing unit 60A.

At next step S210, CPU 40 obtains a potential appearing in the detection monitor line which corresponds to the unit to be processed. At next step S212, CPU 40 determines whether or not the potential obtained at step S210 is of low level (LO). That is, CPU 40 determines whether or not the fuse contained in the unit to be processed has been blown.

If the potential obtained at step S210 is of low level (LO) (YES at step S212), the process proceeds to step S214. If the potential obtained at step S210 is not of low level (LO) (NO at step S212), the process proceeds to step S218.

At step S214, CPU 40 determines that checking of operation of the fuse blowing circuit has been completed normally. Here, CPU 40 stores information that checking of operation of the fuse blowing circuit corresponding to the unit to be processed has been completed normally in nonvolatile memory 42 (FIG. 2). At next step S216, CPU 40 performs an initialization process on the unit to be processed. Specifically, a calibration process for gray scale, a stabilization process, reset of various count values and the like are performed. Then, the process returns to the fuse blowing subroutine shown in FIG. 8.

At step S218, CPU 40 determines that checking of operation of the fuse blowing circuit has not been completed normally (error). Here, CPU 40 stores information that checking of operation of the fuse blowing circuit corresponding to the unit to be processed has been completed with an error in nonvolatile memory 42 (FIG. 2). At next step S220, CPU 40 performs an error process. This error process includes suspending subsequent processes, and notifying an operation panel and the like of the error.

As described above, in the processing subroutine for fuse shown in FIG. 9, when fuse blowing circuit 50 supplies a current for blowing fuse 63 to the unit containing fuse 63 (fuse-containing unit 60A), operation of fuse blowing circuit 50 is checked based on the potential detected before current supply (step S202) and the potential detected after current supply (step S212).

(4. Processing Subroutine For Resistor)

Figure 10:
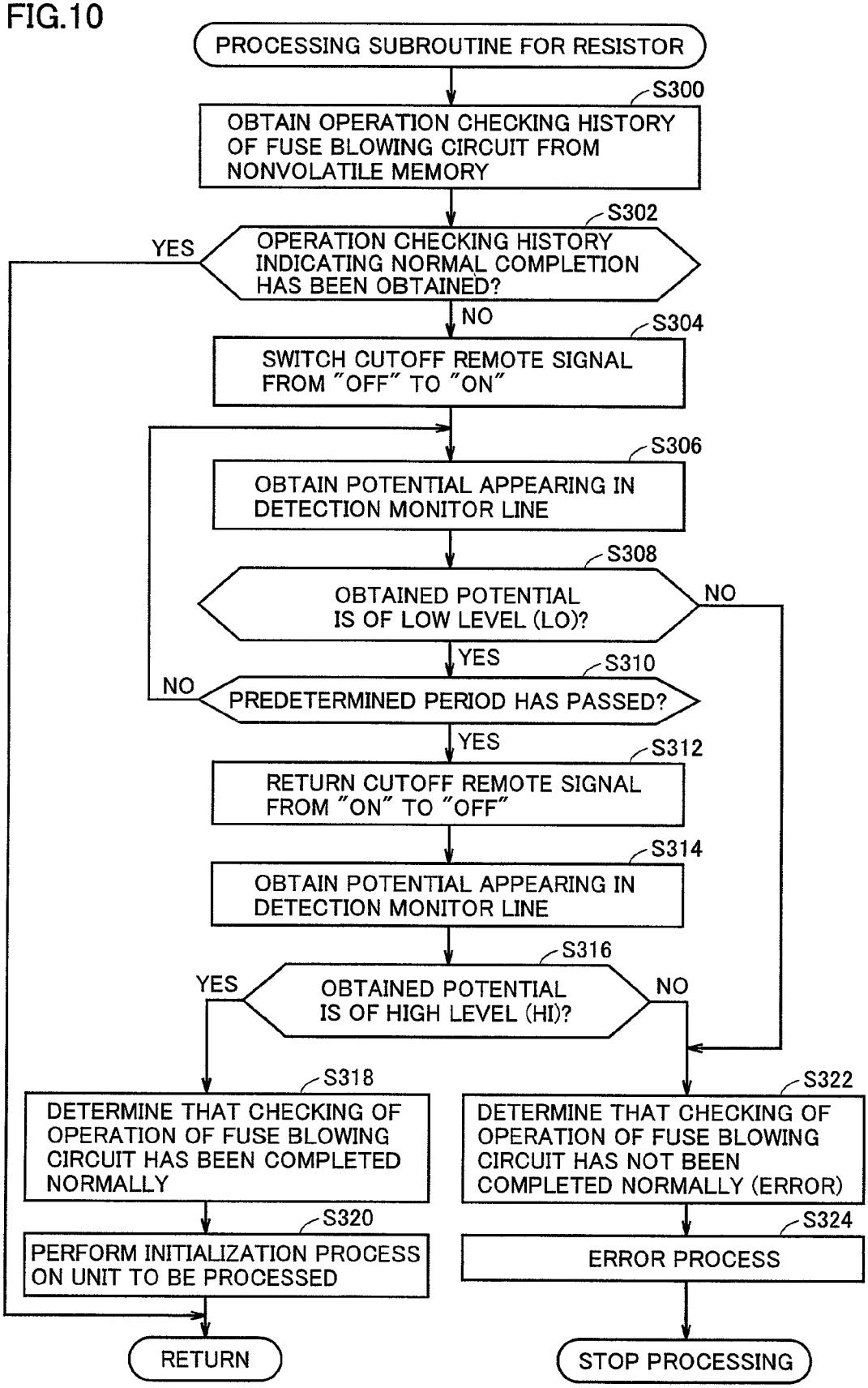
FIG. 10 is a flowchart showing contents of a processing subroutine for resistor performed at step S108 shown in FIG. 8.

Next, referring to FIG. 10, the contents of the processing subroutine for resistor executed at step S108 shown in FIG. 8 are described.

First, at step S300, CPU 40 obtains an operation checking history of a fuse blowing circuit corresponding to a unit to be processed, from nonvolatile memory 42 (FIG. 2). At next step S302, CPU 40 determines whether or not an operation checking history indicating normal completion has been obtained at step S300. That is, CPU 40 determines whether or not operation of the fuse blowing circuit corresponding to the unit to be processed has been checked by the fuse blowing subroutine executed in the past, and whether or not the checking has been completed normally.

If an operation checking history indicating normal completion has been obtained (YES at step S302), the process returns to the fuse blowing subroutine shown in FIG. 8. If an operation checking history indicating normal completion has not been obtained (NO at step S302), the process proceeds to step S304. Then, CPU 40 checks operation of fuse blowing circuit 50 and the like at step S304 and its subsequent steps.

That is, if operation of fuse blowing circuit 50 has not been checked in the past for resistor-containing unit 60B, a current for checking operation of fuse blowing circuit 50 is supplied.

Since it is assumed that the fuse blowing operation for resistor-containing unit 60B is performed at a fabrication stage, it is assumed that nonvolatile memory 42 (FIG. 2) does not have an operation checking history when resistor-containing unit 60B is first mounted on image forming device 100. In this case, it is determined as "NO" at the process of step S302.

At step S304, CPU 40 switches the cutoff remote signal from "OFF" to "ON". That is, CPU 40 causes fuse blowing circuit 50 to supply a current to resistor 62 contained in mounted resistor-containing unit 60B.

At next step S306, CPU 40 obtains a potential appearing in the detection monitor line which corresponds to the unit to be processed. At next step S308, CPU 40 determines whether or not the potential obtained at step S306 is of low level (LO).

If the potential obtained at step S306 is of low level (LO) (YES at step S308), the process proceeds to step S310. If the potential obtained at step S306 is not of low level (LO) (NO at step S308), the process proceeds to step S322.

At step S310, CPU 40 determines whether or not a predetermined period has passed since the cutoff remote signal was switched from "OFF" to "ON". If the predetermined period has not passed since the cutoff remote signal was switched from "OFF" to "ON" (NO at step S310), CPU 40 repeats the process of step S306 and its subsequent steps. If the predetermined period has passed since the cutoff remote signal was switched from "OFF" to "ON" (YES at step S310), the process proceeds to step S312.

That is, at steps S304 to S310, CPU 40 determines whether or not the resistor contained in the unit to be processed has been blown during the period when the cutoff remote signal is "ON".

At step S312, CPU 40 returns the cutoff remote signal from "ON" to "OFF." At next step S314, CPU 40 obtains a potential appearing in the detection monitor line which corresponds to the unit to be processed. At next step S316, CPU 40 determines whether or not the potential obtained at step S314 is of high level (HI). That is, CPU 40 determines whether or not the resistor contained in the unit to be processed has been blown.

If the potential obtained at step S314 is of high level (HI) (YES at step S316), the process proceeds to step S318. If the potential obtained at step S314 is not of high level (HI) (NO at step S316), the process proceeds to step S322.

At step S318, CPU 40 determines that checking of operation of the fuse blowing circuit has been completed normally. Here, CPU 40 stores information that checking of operation of the fuse blowing circuit corresponding to the unit to be processed has been completed normally in nonvolatile memory 42 (FIG. 2). At next step S320, CPU 40 performs an initialization process on the unit to be processed. Specifically, a calibration process for gray scale, a stabilization process, reset of various count values and the like are performed. Then, the process returns to the fuse blowing subroutine shown in FIG. 8.

At step S322, CPU 40 determines that checking of operation of the fuse blowing circuit has not been completed normally (error). Here, CPU 40 stores information that checking of operation of the fuse blowing circuit corresponding to the unit to be processed has been completed with an error in nonvolatile memory 42 (FIG. 2). At next step S324, CPU 40 performs an error process. This error process includes suspending subsequent processes, and notifying an operation panel and the like of the error.

As described above, in the processing subroutine for resistor shown in FIG. 10, when fuse blowing circuit 50 supplies a current to the unit containing the resistance element which is a non-blown component instead of fuse 63 (resistor-containing unit 60B), operation of fuse blowing circuit 50 is checked based on the potential detected before current supply (step S302) and the potential detected during current supply (step S308), or the potential detected before current supply (step S302) and the potential detected after current supply (step S316).

The high level and the low level of the potential appearing in the detection monitor line may be exchanged depending on a point where a potential is detected in the circuit.

Therefore, in the former determination logic (the method of using the potentials detected by the detection circuit before current supply and during current supply, respectively), operation of fuse blowing circuit 50 is determined to be normal if the potential detected while fuse blowing circuit 50 supplies a current to resistor-containing unit 60B is different from the potential detected while fuse blowing circuit 50 does not supply a current to resistor-containing unit 60B.

In the latter determination logic (the method of using the potentials detected by the detection circuit before current supply and after current supply, respectively), on the other hand, operation of fuse blowing circuit 50 is determined to be normal if the potential detected after fuse blowing circuit 50 supplies a current to resistor-containing unit 60B over a certain period is not different from the potential detected while fuse blowing circuit 50 does not supply a current to resistor-containing unit 60B.

<G. Application>

Figure 11:
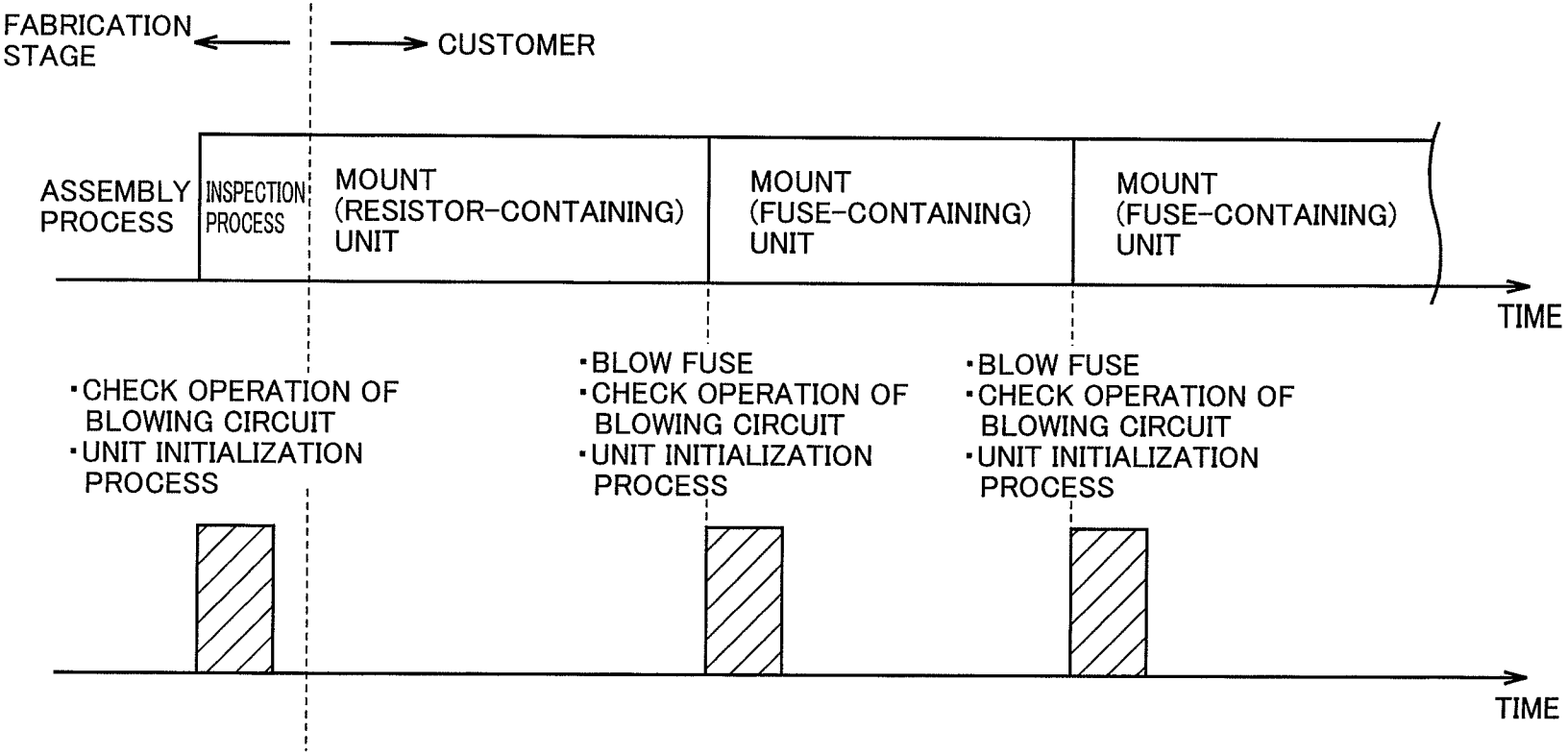
FIG. 11 shows an application of the image forming device according to an embodiment of the present invention.

Referring to FIG. 11, basically, resistor-containing unit 60B is mounted at a fabrication stage of image forming device 100 according to the present embodiment. That is, resistor-containing unit 60B is used as an included item of shipped image forming device 100. Accordingly, the above fuse blowing process shown in FIG. 8 is generally performed during an inspection process of the fabrication stage, and operation of fuse blowing circuit 50 is checked as well following the above processing subroutine for resistor shown in FIG. 10. An initialization process on the mounted resistor-containing unit is also performed.

Then, image forming device 100 is shipped to and used by a customer. When one of the units reaches the end of its life after image forming device 100 has been used, the unit is replaced with a new unit. Here, fuse-containing unit 60A is used as the new unit. Accordingly, when fuse-containing unit 60A is mounted on image forming device 100, fuse 63 contained in fuse-containing unit 60A is blown by the fuse blowing process shown in FIG. 8. Further, operation of fuse blowing circuit 50 is checked, and an initialization process on this unit is performed.

Thereafter, each unit which reaches the end of its life will be successively replaced with fuse-containing unit 60A.

<H. Other Embodiments>

A program causing execution of control as described in the above embodiment may be provided in any manner. Such program may be provided as recorded on a non-transitory computer readable storage medium such as a flexible disk, a CD-ROM (Compact Disk-Read Only Memory), a ROM (Read Only Memory), a RAM (Random Access Memory), and a memory card. Alternatively, a program may be provided by downloading through a network.

<I. Conclusion>

In the image forming device according to the present embodiment, when an initialization process is performed on a replaceable unit which indicates a state thereof depending on whether or not a contained fuse has been blown, the fuse is blown such that a different state is indicated. Operation of a fuse blowing circuit can be checked when the fuse is blown. Moreover, in the image forming device according to the present embodiment, even if a unit containing a resistor instead of the fuse in the above unit for reduced costs is mounted, operation of the fuse blowing circuit can be checked in the same manner as when the unit containing the fuse is mounted.

Accordingly, typically by changing a unit included in an image forming device or the like shipped from a factory to a fuse-containing unit such as described above, the costs can be further reduced and operation of a fuse blowing circuit can be checked in a conventional manner without causing inconvenience to a user. Therefore, quality of a shipped image forming device can be maintained.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming device comprising:

an interface for mounting a replaceable unit;

a blowing circuit for supplying a current for blowing a fuse when a unit containing the fuse is mounted;

a detection circuit forming a circuit including the fuse contained in the mounted unit, for detecting a potential varying depending on whether or not the fuse has been blown; and a controller, wherein when a unit containing a fuse is mounted, in response to detection of a potential indicating that the fuse has not been blown by said detection circuit, said controller causes said blowing circuit to supply a current for blowing the fuse to the mounted unit containing the fuse, and checks operation of said blowing circuit based on potentials detected by said detection circuit before current supply and after current supply, respectively, and when a unit containing a non-blown component instead of a fuse is mounted, said controller causes said blowing circuit to supply a current to the mounted unit containing the non-blown component, and checks operation of said blowing circuit based on potentials detected by said detection circuit before current supply and during current supply, respectively, or potentials detected by said detection circuit during current supply and after current supply, respectively, wherein if the detected potentials differ in value, the controller determines normal operation of said blowing circuit.

2. The image forming device according to claim 1, wherein said replaceable unit includes an identification component indicating which one of said fuse and said non-blown component is contained, and said image forming device further comprises a type-specifying circuit for specifying a type of a mounted unit by electrical connection to said identification component.

3. The image forming device according to claim 1, wherein said controller is configured to determine that said blowing circuit is operating normally if a potential detected by said detection circuit while said blowing circuit supplies a current to said unit containing the non-blown component instead of a fuse is different from a potential detected by said detection circuit while said blowing circuit does not supply a current to the unit.

4. The image forming device according to claim 1, wherein said controller is configured to determine that said blowing circuit is operating normally if a potential detected by said detection circuit after said blowing circuit supplies a current to said unit containing the non-blown component instead of a fuse over a certain period is not different from a potential detected by said detection circuit while said blowing circuit does not supply a current to the unit.

5. The image forming device according to claim 1, wherein said blowing circuit is configured to supply a current to said unit containing the non-blown component instead of a fuse when operation of said blowing circuit for said unit has not been checked in the past.

6. The image forming device according to claim 5, wherein said controller includes a storage unit for storing a history of checking operation of said blowing circuit.

7. The image forming device according to claim 1, wherein said non-blown component is a resistance element.

8. A method of checking operation of an image forming device with a mounted replaceable unit, said image forming device including an interface capable of mounting any one of a first type unit containing a fuse for indicating whether the unit is in a first state or a second state, and a second type unit containing a non-blown component instead of the fuse in the first type unit, said method comprising the steps of:

specifying, after said replaceable unit is mounted on said image forming device, whether the mounted unit is of the first type or the second type;

detecting, when it is specified that the first type unit has been mounted, a potential varying depending on whether or not the fuse has been blown by a detection circuit forming a circuit together with the fuse contained in the unit;

determining whether the mounted first type unit is in said first state or said second state based on the detected potential;

supplying a current for blowing the fuse contained in the unit from a blowing circuit when the mounted first type unit is in said first state;

checking operation of said blowing circuit based on potentials detected before current supply and after current supply, respectively, at said detection circuit including the fuse contained in the mounted first type unit;

determining whether or not operation of said blowing circuit has been checked in the past when it is specified that the second type unit has been mounted;

supplying a current to the non-blown component contained in the mounted second type unit from said blowing circuit when operation of said blowing circuit has not been checked in the past; and checking operation of said blowing circuit based on potentials detected by said detection circuit before current supply and during current supply, respectively, or potentials detected by said detection circuit before current supply and after current supply, respectively, said detection circuit forming a circuit together with the non-blown component contained in the mounted second type unit.

9. A non-transitory storage medium storing an operation checking program to be executed by an image forming device with a mounted replaceable unit, said image forming device including an interface capable of mounting any one of a first type unit containing a fuse for indicating whether the unit is in a first state or a second state, and a second type unit containing a non-blown component instead of the fuse in the first type unit, said operation checking program comprising:

instructions for specifying, after said replaceable unit is mounted on said image forming device, whether the mounted unit is of the first type or the second type;

instructions for obtaining, when it is specified that the first type unit has been mounted, a potential varying depending on whether or not the fuse has been blown from a circuit including the fuse contained in the unit;

instructions for determining whether the mounted first type unit is in said first state or said second state based on the obtained potential;

instructions for causing a blowing circuit to supply a current for blowing the fuse contained in the unit when the mounted first type unit is in said first state;

instructions for checking operation of said blowing circuit based on potentials before current supply and after current supply, respectively, obtained from the circuit including the fuse contained in the mounted first type unit;

instructions for determining whether or not operation of said blowing circuit has been checked in the past when it is specified that the second type unit has been mounted;

instructions for supplying a current to the non-blown component contained in the mounted second type unit from said blowing circuit when operation of said blowing circuit has not been checked in the past; and instructions for checking operation of said blowing circuit based on potentials detected before current supply and during current supply, respectively, or potentials detected before current supply and after current supply, respectively, at a circuit including the non-blown component contained in the mounted second type unit.

* * * * *